United States Patent [19]

Takada

[11] 4,408,969

[45] Oct. 11, 1983

[54] VANE COMPRESSOR HAVING IMPROVED ROTOR SUPPORTING MEANS

[75] Inventor: Haruhiko Takada, Konan, Japan

[73] Assignee: Diesel Kiki Co., Ltd., Saitama, Japan

[21] Appl. No.: 265,578

[22] Filed: May 20, 1981

[30] Foreign Application Priority Data

May 31, 1980 [JP] Japan ..... 55-72935

[51] Int. Cl.[3] ..... F04C 18/00; F04C 29/02

[52] U.S. Cl. ..... 418/93; 418/98; 418/269

[58] Field of Search ..... 418/91, 93, 98, 259, 418/266, 269

[56] References Cited

U.S. PATENT DOCUMENTS

| | | | |
|---|---|---|---|
| 2,068,803 | 1/1937 | Johnson | 418/91 |
| 3,796,526 | 3/1974 | Cawley | 418/97 |
| 3,852,003 | 12/1974 | Adalbert et al. | 418/93 |
| 4,061,450 | 12/1977 | Christy | 418/259 |
| 4,244,680 | 1/1981 | Ishizuka et al. | 418/97 |

FOREIGN PATENT DOCUMENTS

| | | | |
|---|---|---|---|
| 100899 | 9/1925 | Fed. Rep. of Germany | 418/91 |
| 573821 | 4/1933 | Fed. Rep. of Germany | 418/91 |
| 629501 | 7/1927 | France | 418/259 |
| 455266 | 2/1950 | Italy | 418/269 |

*Primary Examiner*—John J. Vrablik
*Assistant Examiner*—Paul F. Neils
*Attorney, Agent, or Firm*—Frishauf, Holtz, Goodman and Woodward

[57] ABSTRACT

A vane compressor is provided which includes a rotor which has an internal space formed at its central portion and communicating with a plurality of vane-inserted slits formed in its outer peripheral surface, and first and second axial through holes extending from the internal space to its opposite end surfaces. The drive shaft extends through an end wall member of the pump housing and has its end portion rigidly fitted in the first axial through hole of the rotor. The second axial through hole of the rotor receives a support shaft projecting from the other or opposite end wall member of the pump housing. Thus, the rotor is radially supported at its one end by the drive shaft and at its other end by the support shaft, respectively.

13 Claims, 4 Drawing Figures

VANE COMPRESSOR HAVING IMPROVED ROTOR SUPPORTING MEANS

BACKGROUND OF THE INVENTION

This invention relates to a vane compressor for compressing a fluid such as refrigerant circulating within an air conditioning system.

A vane compressor in general comprises a drive shaft arranged to be rotated by a prime mover; a rotor arranged for rotation in unison with the drive shaft and formed with a plurality of axial slits in its outer peripheral surface; a plurality of vanes radially movably received in the axial slits; a pump housing having an endless camming inner peripheral surface and accommodating the rotor and the vanes, the rotor, vanes and pump housing defining in cooperation pump working chambers therebetween; and a casing enclosing the pump housing to define a discharge pressure chamber between itself and the pump housing. Rotation of the rotor causes gaseous medium such as refrigerant to be pressurized within the pump working chambers and discharged to the outside through the discharge pressure chamber.

In compressors of this kind are generally employed mainly two types of rotor supporting means. One of them is used in vane compressors manufactured by the assignee of the present application, according to which, as known e.g. from U.S. Pat. No. 4,244,680, the drive shaft has its end portion fitted through the rotor in a manner radially supporting it, with its end face located on substantially the same plane with an associated end face of the rotor. The drive shaft radially supportedly penetrates through a radial bearing portion formed in one of two opposite side blocks forming the two end walls of the pump housing. The other type rotor supporting means, which is known e.g. from U.S. Pat. No. 3,250,460, is such that the drive shaft extends through the rotor, with its end projecting from an associated end face of the rotor and supportedly fitted in a corresponding side block of the pump housing, while simultaneously the rotor is also radially supported by the drive shaft along its entire length.

According to the above two conventional rotor supporting means, the drive shaft is fitted through the rotor along the entire length of the latter. That is, a considerable portion of the drive shaft is present within the rotor so that the substantial mass of the rotor portion is large, resulting in large energy loss during rotation of the rotor.

OBJECT AND SUMMARY OF THE INVENTION

It is the object of the invention to provide a vane compressor in which the mass of a portion of the drive shaft present within the rotor is much smaller than that of a conventional vane compressor such that a large-volume chamber or internal space is formed within the rotor, making the rotor lighter in weight.

According to the invention, the rotor has an internal space formed at its central portion in communication with vane-fitted slits formed in its outer peripheral surface, and first and second axial through holes extending from the internal space to its opposite end faces. The pump housing is formed of an annular peripheral wall member and first and second end wall members secured to the opposite ends of the annular peripheral wall member. The first end wall member has an axially extending bearing through hole formed centrally thereof, through which the drive shaft penetrates with its end portion rigidly fitted in the first axial through hole of the rotor to radially support the rotor for rotation in unison therewith. The second end wall member has a support shaft projecting therefrom and fitted in the second axial through hole of the rotor to radially support the rotor for rotation relative thereto.

The above and other objects, features and advantages of the invention will be more apparent from the ensuing detailed description taken in connection with the accompanying drawings in which:

DETAILED DESCRIPTION

The invention will be described in detail with reference to the drawings.

Figure 1:
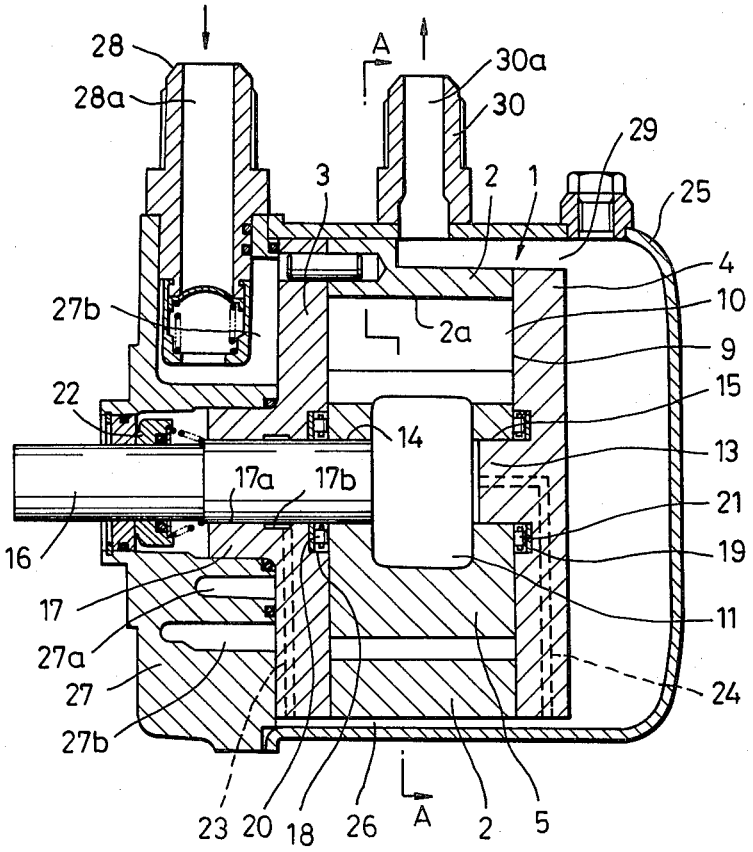
FIG. 1 is a longitudinal sectional view of a vane compressor according to an embodiment of the present invention.
Figure 2:
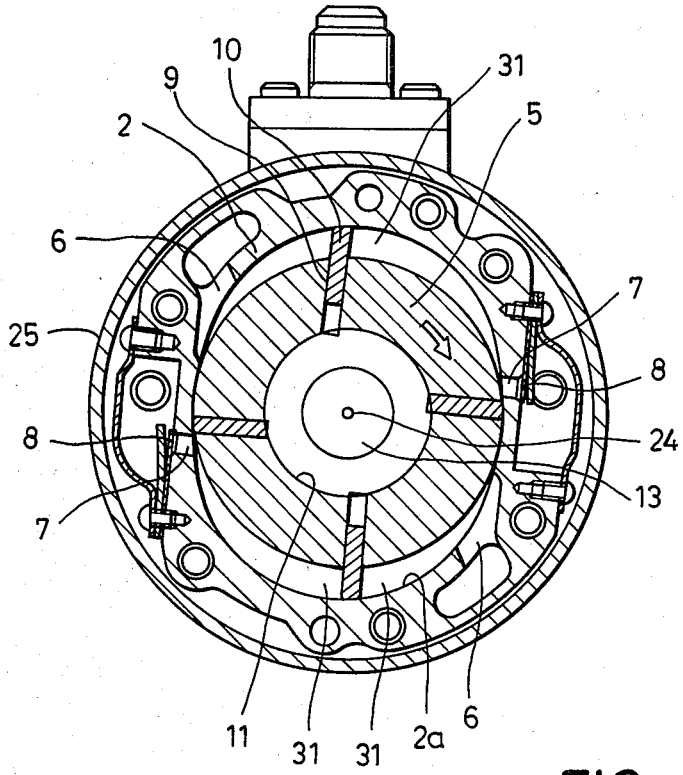
FIG. 2 is a sectional view taken on line A—A of FIG. 1.

FIGS. 1 and 2 illustrated a vane compressor according to an embodiment of the invention. The compressor has a pump housing 1 which is formed of a cam ring 2 having an endless camming inner peripheral surface having an oval cross section, and a front side block 3 and a rear side block 4 secured to the opposite ends of the cam ring 2. A cylindrical rotor 5 is rotatably received within the pump housing 1.

The cam ring 2 has its peripheral wall formed therein with each one pair of pump inlets 6, 6 and pump outlets 7, 7, the pump inlets or outlets of each pair being arranged diametrically symmetrically. A pair of discharge valves 8, 8 are mounted on the outer peripheral wall of the cam ring 2 in opposed relation to the respective pump outlets 7, 7.

The rotor 5 has four axial slits 9 opening in its outer peripheral surface and circumferentially arranged at equal intervals, in each of which slits is received a vane 10 for radial movement.

The rotor 5 is further formed therein with a chamber 11 having a circular cross section, located at its central portion in concentricity therewith. The chamber 11 has a much larger diameter than that of the drive shaft 16 and communicates with the slits 9 at their bottoms. The length of the chamber 11 is set such that portions of the rotor 5 located between the chamber 11 and the opposite end faces of the rotor 5 have suitable thicknesses, that is, such thicknesses as to ensure steady rigid coupling of a drive shaft 16, hereinafter referred to, to the rotor, as well as positive supporting of the rotor by a support shaft 13, also hereinafter referred to. However, the length of the chamber 11 should preferably be designed to be at least approximately half of the entire length of the rotor 5 to obtain a substantial reduction in the weight of the rotor 5. It has been ascertained by the inventor that even if the length of the rotor 5 is set at such a value, sufficient supporting of the rotor 5 by the drive shaft 16 and the support shaft 13 can be obtained.

The rotor 5 is also formed therein with axial through holes 14, 15 extending along its axis from the chamber 11 to the respective opposite end faces. The drive shaft 16 has its end portion force fitted in the axial through hole 14 and rigidly secured to the rotor 5 to radially support it. The right end face of the drive shaft 16 as viewed in FIG. 1 is located on substantially the same plane with the corresponding end wall face of the chamber 11. The drive shaft 16 penetrates through a bearing through hole 17*a* axially extending through a boss-shaped radial bearing portion 17 formed integrally on the front side block 3 at its central portion, the drive shaft 16 being rotatably supported by the bearing portion 17. Fitted in the other axial through hole 15 is the support shaft 13 which is formed integrally on the rear side block 4 at its central portion and inwardly projects perpendicularly therefrom. Thus, the rotor has its right half portion, as viewed in FIG. 1, rotatably radially supported by the support shaft 13 fitted in its hole 15. Although in the illustrated embodiment the end face of the support shaft 13 terminates in the hole 15 at a slight distance from the chamber 11, the support shaft 13 may alternatively be designed to have its end face located on substantially the same plane with the corresponding end wall face of the chamber 11.

The front side block 3 has its inner end face formed therein with an annular groove 18 located around the axial hole 17*a* in the radial bearing portion 17, in which groove is received a thrust bearing 20. On the other hand, the rear side block 4 has its inner end face formed therein with an annular groove 19, too, located around the root of the support shaft 13, in which groove is received another thrust bearing 21. Thus, the rotor 5 is supported in the axial directions by these thrust bearings 20, 21 and simultaneously prohibited from axial dislocation.

The drive shaft 16 has its left end portion, as viewed in FIG. 1, projected to the outside of the compressor body, on which is mounted a magnetic clutch, not shown, through which clutch is transmitted torque from a prime mover such as an engine, not shown, to the drive shaft 16. In FIG. 1, reference numeral 22 designates an oil seal mounted around the drive shaft 16.

The front and rear side blocks 3, 4 have their lower portions formed therein with lubricating oil feeding passages 23, 24, respectively. The passage 23 opens at its one end in a lubricating oil reservoir 26 formed between the bottom of the pump housing and a casing 25, hereinafter referred to, and communicates at its outer end with an annular groove 17*b* formed in the inner peripheral wall of the bearing through hole 17*a* of the radial bearing portion 17. The oil reservoir 26 communicates with a discharge pressure chamber 29, hereinafter referred to. Due to a differential pressure produced during operation of the compressor, lubricating oil in the oil reservoir 26 is forced to travel through the feeding passage 23 to be fed to the annular groove 17*b* to lubricate the drive shaft 16. The lubricating oil in the oil reservoir 26 is further guided through the gap between the peripheral walls of the hole 17*a* and the drive shaft 16 to the oil seal 22 and the thrust bearing 20 to lubricate same. The other lubricating oil feeding passage 24 extends from the oil reservoir 26 and opens in an inner end face of the support shaft 13 facing the chamber 11 of the rotor 5, through which passage lubricating oil in the oil reservoir 26 is guided and delivered into the chamber 11 due to the above differential pressure. The lubricating oil thus introduced into the chamber 11 is, on one hand, guided into the slits 9 communicating with the chamber 11, and, on the other hand, fed to the support shaft 13 and the thrust bearing 21 to lubricate same.

Secured to the front side block 3 is a head 27 within which are formed a high pressure chamber 27*a* and a low pressure chamber 27*b*. The high pressure chamber 27*a* communicates with the discharge pressure chamber 29, and the low pressure chamber 27*b* with the pump inlets 6 and a suction port 28*a* formed in a suction connector 28 mounted in the head 27, respectively. Secured to the head 27 is the casing 25 which encloses the pump housing 1 in such a manner that the discharge pressure chamber 29 is defined between the inner wall of the casing 25 and the outer walls of the pump housing 1. This discharge pressure chamber 29 communicates with the pump outlets 7 and the above-mentioned high pressure chamber 27*a*. Mounted in the casing 25 is a discharge connector 30 which has a discharge port 30*a* opening in the discharge pressure chamber 29.

With the above arrangement, when the drive shaft 16 rotates, the rotor 5 secured to the drive shaft 16 at its hole 14 is rotated in unison therewith in a manner supported by the drive shaft 16 and the support shaft 13. The vanes 10 in the axial slits 9 are pushed radially outwardly due to centrifugal force caused by the rotation of the rotor 5 and back pressure caused by lubricating oil introduced into the slits 9 to slide against the inner peripheral wall of the cam ring 2.

During rotation of the rotor 5, pump working chambers 31 are formed between adjacent vanes 10, 10, the inner walls of the pump housing 1 and the outer peripheral wall of the rotor 5. Each chamber 31 increases in volume on its suction stroke and decreases in volume on its discharge or compression stroke. Each time one of the vanes 10 passes each of the pump inlets 6, refrigerant is sucked into an associated pump working chamber 31 and pressurized within the chamber 31 on its discharge or compression stroke to be discharged into the discharge pressure chamber 29 through an associated pump outlet 7 and an associated discharge valve 8 opened by the pressure of the refrigerant. The pressurized refrigerant within the discharge pressure chamber 29 is then discharged through the discharge port 30*a*. The vanes 10 individually perform radial movements in the slits 9 while sliding along the inner peripheral surface of the cam ring 2. The presence of the chamber 11 having a large internal volume causes a noticeable reduction in back pressure fluctuations which are applied to the vanes 10 during their radial movements. Especially, an increase in the back pressure caused by retraction of the vanes 10 can be reduced, resulting in smooth movement of the vanes 10.

Figure 3:
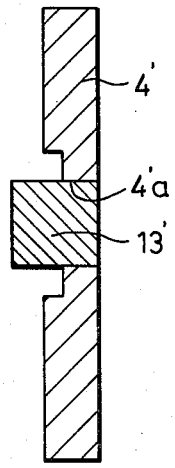
FIG. 3 is a sectional view showing a variation of the rear side block used in the compressor of the invention.

FIG. 3 illustrates a modification of the rear side block of the pump housing 1. The rear side block 4' has its central portion formed with a through hole 4'*a* in which a cylindrical member 13' which is separately fabricated from the block 4' is rigidly force fitted at its one end portion, with its other end portion projecting from the block 4'. The other end portion of the cylindrical member 13' is to be inserted into the hole 15 in the rotor 5 so as for the latter to be rotatable relative thereto, like the support shaft 13 integrally formed on the rear side block 4 in FIG. 1. The cylindrical member 13' is formed of a material different from that of the rear side block 4' and the rotor 5 which are usually formed of cast iron, such as brass, aluminum or an alloy thereof to prevent its seizure on the rotor 5. If the rotor 5 is formed of a sintered alloy such as copper-containing iron, the cylindrical member 13' may be formed of cast iron to keep good lubrication of the rotor and the cylindrical member 13'.

Figure 4:
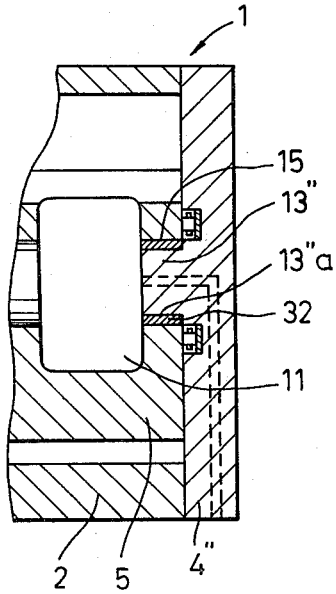
FIG. 4 is a longitudinal sectional fragmentary view of another embodiment of a coupling between the rear side block and the rotor of the invention.

FIG. 4 illustrates a still further modification of the rear side block. An annular radial bearing metal member 32 is interposed between a support shaft 13'' projecting integrally from the rear side block 4'' and the hole 15 in the rotor 5. This member 32 can be formed of a material identical with or similar to the above-mentioned materials for the separately fabricated support shaft 13' shown in FIG. 3, to obtain improved lubrication as well as prevention of seizure. Although in the example of FIG. 4, the bearing metal member 32 is fitted in an annular groove **13''*a* formed in the support shaft 13'', an annular groove having a suitable shape may alternatively be formed in the inner peripheral wall of the hole 15 of the rotor 5 and the metal member 32** may be fitted in the above annular groove.

Obviously many modifications and variations of the present invention are possible in the light of the above teachings. It is therefore to be understood that within the scope of the appended claims the invention may be practiced otherwise than as specifically described.

What is claimed is:

1. In a vane compressor including: a pump housing comprising an annular peripheral wall member having an endless camming inner peripheral surface, and first and second end wall members secured to opposite ends of said annular peripheral wall member; a cylindrical rotor rotatably received within said pump housing, said rotor having a plurality of axial slits formed in an outer peripheral surface thereof; a plurality of vanes radially movably received in said slits; and a drive shaft coupled to said rotor for causing rotation of said rotor in unison therewith, said drive shaft being formed of a member separate and discrete from said rotor;

the improvement wherein:

said rotor has an internal space formed at a central portion thereof in communication with said slits, said rotor having opposite end wall faces, and first and second axial through holes extending from said internal space to respective opposite end faces thereof, said first end wall member of said pump housing having an axially extending bearing through hole formed at a central portion thereof, said drive shaft extending through said bearing through hole of said first end wall member and having an end portion thereof fitted in said first axial through hole of said rotor and rigidly secured to said rotor at said first axial through hole to radially support said rotor for rotation in unison therewith;

said drive shaft having an end face thereof located on substantially the same plane with a corresponding one of said opposite end wall faces of said internal space of said rotor;

said second end wall member having a support shaft projecting therefrom and fitted in said second axial through hole of said rotor to radially support said rotor for rotation relative thereto; and said support shaft extending toward said internal space substantially as far as the other end wall face of said internal space of said rotor.

2. An improved vane compressor as recited in claim 1, further comprising a radial bearing member interposed between said second axial through hole of said rotor and said support shaft of said second end wall member to directly radially support said rotor.

3. An improved vane compressor as recited in claim 1, further comprising: lubricating means for feeding lubricating oil to said internal space; and wherein said slits formed in said rotor each have a radially inner end communicating with said internal space whereby back pressure is applied to said vanes by said lubricating oil.

4. An improved vane compressor as recited in claim 1, wherein said internal space has a width which is at least approximately half of the entire width of said rotor.

5. An improved vane compressor as recited in claim 1 or 3, wherein said internal space has a diameter which is considerably larger than that of said drive shaft.

6. An improved vane compressor as recited in claim 1, wherein said support shaft of said second end wall member has an end face thereof terminating in said second axial through hole of said rotor at a slight distance from said internal space of said rotor.

7. An improved vane compressor as recited in claim 1, wherein said support shaft of said second end wall member has an end face thereof located on substantially the same plane with a corresponding end wall face of said internal space of said rotor.

8. An improved vane compressor as recited in claim 1, wherein said support shaft of said second end wall member is formed integrally on said second end wall member.

9. An improved vane compressor as recited in claim 1, wherein said support shaft of said second end wall member is fabricated through a separate manufacturing process from said second end wall member.

10. An improved vane compressor as recited in any one of claims 1, 6, 7, 8 or 9, further comprising first thrust bearing means interposed between an end face of said first end wall member and a corresponding end face of said rotor, and second thrust bearing means interposed between an end face of said second end wall member and another corresponding end face of said rotor, said first and second thrust bearing means axially supporting said rotor.

11. An improved vane compressor as recited in any one of claims 1, 6, 7, 8 or 9, wherein said first end wall member has a lubricating oil feeding passage formed therein, said passage having one end thereof communicating with a zone under discharge pressure within said compressor and another end thereof opening in an inner peripheral wall of said bearing through hole formed in said first end wall member whereby lubricant oil is fed from said zone to said internal space through said passage due to pressure difference between said zone and said internal space.

12. An improved vane compressor as recited in any one of claims 1, 6, 7, 8 or 9, wherein said second end wall member has a lubricating oil feeding passage formed therein, said passage having one end thereof communicating with a zone under discharge pressure within said compressor and another end thereof opening in an inner end face of said support shaft of said second end wall member.

13. An improved vane compressor as recited in claim 9, wherein said second end wall member has its central portion formed with a central through hole, and said support shaft is rigidly force fitted in said central through hole.

* * * * *